United States Patent [19]

Penner

[11] 4,307,632

[45] Dec. 29, 1981

[54] RATCHET WRENCH OF THE SOCKET DRIVE TYPE WITH SOCKET EJECTOR

[76] Inventor: John Penner, P.O. Box 1348, Avondale, Ariz. 85323

[21] Appl. No.: 141,165

[22] Filed: Apr. 17, 1980

Related U.S. Application Data

[63] Continuation of Ser. No. 9,459, Feb. 5, 1979, abandoned.

[51] Int. Cl.[3] ..... B25B 13/46

[52] U.S. Cl. ..... 81/63; 81/177 G

[58] Field of Search ..... 81/60–63, 81/177 G; 192/43.1

[56] References Cited

U.S. PATENT DOCUMENTS 3,393,587 7/1968 Lolliff et al. ..... 81/63.2

3,881,376 5/1975 Wright ..... 81/177 G

*Primary Examiner*—James L. Jones, Jr.

*Attorney, Agent, or Firm*—Wm. T. Wofford

[57] ABSTRACT

A ratchet wrench of the socket drive type with a socket ejector has a control knob recessed within and reciprocable within a ratchet plug body for independently actuating both the ratchet reversing device and socket ejector.

2 Claims, 5 Drawing Figures

RATCHET WRENCH OF THE SOCKET DRIVE TYPE WITH SOCKET EJECTOR

This is a continuation of application Ser. No. 9,459, filed Feb. 5, 1979, now abandoned.

FIELD OF THE INVENTION

The invention relates to ratchet wrenches and more particularly to improved ratchet wrenches of the socket drive type that incorporate socket ejector means.

BACKGROUND OF THE INVENTION

One of the most common types of mechanic's wrenches currently in use is the socket with a ratchet drive. The ratchet drive accommodates a number of sockets having a range of sizes to make up a set. A selected socket is received on a drive stud and is normally retained thereon by means of a detent device. Some ratchet drives of the prior art of which I am aware, as exemplified by U.S. Pat. Nos. 3,815,451 and 3,881,376, incorporate socket ejector means, so that sockets can be removed from the drive stud by depressing an ejector control. Such prior art ratchet drives are, however, subject to various deficiencies and are susceptible to improvement.

It is accordingly the general object of the present invention to provide an improved ratchet wrench of the type utilizing sockets with a ratchet drive and incorporating socket ejector means.

For a further understanding of the invention and further objects, features, and advantages thereof, reference may now be had to the following description, taken in conjunction with the accompanying drawings.

DESCRIPTION OF PREFERRED EMBODIMENT

Figure 1:
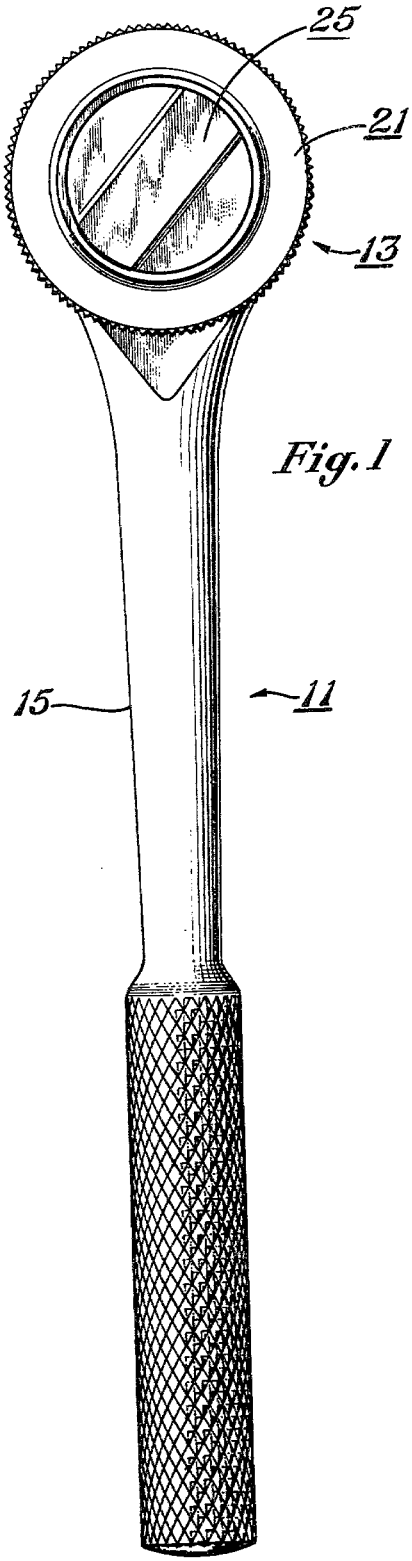
FIG. 1 is a top plan view of a typical ratchet wrench with socket drive and incorporating socket ejector means, in accordance with a preferred embodiment of the invention.
Figure 2:
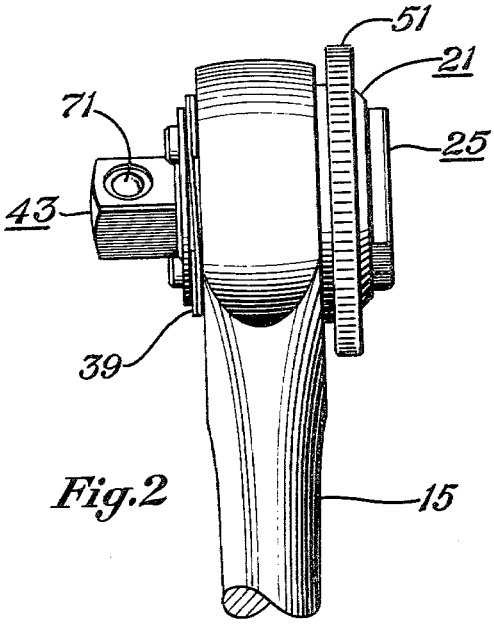
FIG. 2 is a side elevational view of the ratchet wrench of FIG. 1, without a socket installed and with a portion of the handle removed.

For convenience, a ratchet wrench with socket drive and socket ejector means which incorporates improvements in accordance with a preferred embodiment of the invention will first be described and then the improvements will be discussed.

Referring now to the drawings it can be seen that the ratchet drive is made up of a handle 11 and a ratchet plug assembly 13. The handle 11 has a lever portion 15 which is integrally merged with a cylindrical head portion 17. The cylindrical head portion 17 has a central bore with spline-like teeth 19 formed therein.

The ratchet plug assembly 13 (see FIGS. 3 and 4) includes ratchet plug 21, ratchet pawl 23, control knob 25, ratchet reversing pin 27, reversing pin bias spring 29, first socket ejector pin 31, second socket ejector pin 33, ejector pin retainer plate 35, control knob return spring 37 and ratchet plug assembly retainer ring 39.

The ratchet plug 21 comprises a generally cylindrical body portion 41 and a drive stud portion 43. The cylindrical body portion 41 comprises a cylindrical exterior portion 45, a retainer ring groove 47, a bearing shoulder 49, a spinner control flange 51, a control knob recess 53, a control knob bore 55, a ratchet pawl slot 57, first and second ejector pin bores 59, 61, and a drive stud end surface 62.

The cylindrical exterior portion 45 has a diameter that is slightly less than the minor diameter of the spline-like teeth 19 of the handle head portion 17 and a length that is substantially equal to that of the spline-teeth 19. The cylindrical exterior portion 45 merges at one end with the retainer ring groove 47 and at the other end with the bearing shoulder 49 which in turn merges with the spinner control flange 51. The ratchet pawl slot 57 has parallel side faces that are spaced a distance slightly greater than the width of the ratchet pawl 23 and bottom surfaces that lie in a plane parallel to and passing near the central axis of the ratchet plug 21. The ratchet pawl slot 57 is closely adjacent the retainer ring groove 47, which in turn is closely adjacent the body portion drive stud end surface 62. The end surface 62 is generally planar and is peripendicular to the ratchet plug central axis.

The control knob has a head portion 63 and a stub shaft portion 65. The head portion 63 has the shape of a disc, the top surface of which merges with an integral generally rectangular boss 67. The stub shaft portion 65 is cylindrical and is coaxial with the head portion 63.

The control knob recess 53 is cylindrical; is coaxial with the ratchet plug 21; has a diameter slightly greater than that of the control knob head portion 63; and has a planar bottom surface 69 that is peripendicular to the ratchet plug central axis. The control knob bore 55 is cylindrical; is coaxial with the ratchet plug 21; has a diameter slightly greater than that of the control knob stub shaft portion 65; and merges at its open end with the control knob recess bottom surface 69. The first and second ejector pin bores 59, 61 are cylindrical; have the same diameters, which are slightly greater than those of the ejector pins 31, 33; are disposed on opposite sides of the control knob bore 55; have their axes parallel to that of the control knob bore 55; open at one end of the control knob recess bottom surface 69 and at the other end to the drive stud end surface 62 of the cylindrical body portion 41. A plane containing axes of the ejector pin bores 59, 61 is perpendicular to a plane containing the bottom surface of the ratchet pawl slot 57.

The drive stud portion 43 of the ratchet plug 21 is integral with the cylindrical body portion 41; extends outwardly from the drive stud end surface 62; is coaxial with the ratchet plug 21; has the conventional generally square transverse section shape; is dimensioned to receive the sockets of a set having the corresponding drive size; and is provided with the conventional detent ball 71 and spring (not shown).

The ratchet pawl 23 has a generally arcuate outer surface having a set of axially extending spline-like teeth 73, 74 at each end portion thereof; an inner surface having an axially extending center notch portion 75 with a respective planar portion 77, 79 extending outwardly from each side of the notch portion; a rocker bore 81 extending axially of the ratchet pawl 23 and opening to respective parallel planar pawl side faces 83, 85 with the rocker bore axis being parallel to said spline-like teeth 73, 74 and lying in a plane that bisects the ratchet pawl 23.

The first and second ejector pins 31, 33 are alike and each have a cylindrical exterior surface portion 87 and a flanged head portion 89. The ejector pin retainer plate 35 has a generally rectangular shape with tapered ends; a pair of oppositely disposed end slots 91 and a side slot 93.

To assemble the ratchet plug assembly 13, the respective ejector pins 31, 33 are mounted in the retainer plate end slots 91 which conform with the pin exterior surface portions 87 and space the pins in alignment with the ejector pin bores 59, 61. The retainer plate 35 is then mounted to the control knob 25, with the side slot 93 being conformingly received by a peripheral groove 97 at the inner end of the control knob stub shaft portion 65. The width of the peripheral groove 97 is such that the ejector pin heads 89 are in substantially abutting relation to the inner face 99 of the control knob head portion 63. Next, the ratchet reverse pin 27 and its bias spring 29 are inserted in a transverse bore 101 in the control knob stub shaft portion 65 and the control knob return spring 37 is inserted in the control knob bore 55. Next, the control knob 25, with attachments, is inserted in the ratchet plug control knob recess 53 (see FIGS. 3 and 4); with the ejector pins 31, 33 having been received by the ejector pin bores 59, 61; with the first ejector pin 31 having been passed through the ratchet pawl rocker bore 81, the ratchet pawl having been correctly positioned in the ratchet pawl slot 57; with the ratchet reverse pin 27 having been compressed so as to pass through the control knob bore 55 and then extended so as to bear against the ratchet pawl inner surface; and with the control knob return spring 37 having been received at its outer end by a locator 103 in the outer end of the control knob stub shaft portion 65 and having been compressed so as to bias the control knob 25 to move in the outward direction until the ratchet reversing pin 27 bears against a side face 95 of the ratchet pawl slot 57, at which time the outer surface of the control knob head 63 is substantially flush with the surface of the spinner control flange 51.

To assemble the ratchet plug assembly 13 onto the handle 11, the ratchet plug cylindrical exterior portion 45 is inserted into the bore of the handle cylindrical head portion 17 until the bearing shoulder 49 abuts one side face 105 of the handle cylindrical head portion 17, at which time the retainer ring groove 47 will extend outwardly just beyond the other side face 107 of the handle cylindrical head portion 17. The ratchet plug assembly retainer ring 39 is then installed in the retainer ring groove 47. The ratchet retainer ring may be a conventional commercially available type made of spring strip material formed to have the shape of a circular flat spiral, as shown. The retainer ring 39 can be expanded radially to increase its inner diameter sufficiently to pass over the periphery of the drive stud end surface 62 and then will relax so that its inner diameter will substantially conform to the bottom of the retainer ring groove 47. When the retainer ring 39 is installed, its inner side surface will bear against the adjacent side face 107 of the handle cylindrical head portion 17 so as to substantially prevent axial movement of the ratchet plug assembly 13. When inserting the ratchet plug assembly 13 into the bore of the handle cylindrical head portion 17 it is necessary to rock the ratchet pawl 23 slightly in a direction to compress the ratchet reverse pin bias spring 29, which then permits the teeth 73, 74 of the pawl 23 to pass into the bore of the handle cylindrical head portion 17. When installing pressure on the pawl 23 is released, the bias spring 29 acting on the ratchet reversing pin 27 will rock the ratchet pawl 23 so that its respective teeth 73 or 74 are in proper engagement with the spline-like teeth 19 of the handle cylindrical head portion 17.

Figure 3:
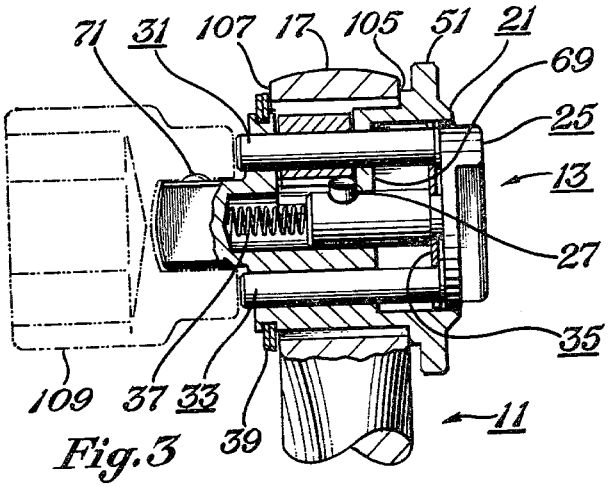
FIG. 3 is a side elevation view, partly in section and partly cut away, showing the interior of the drive assembly of the ratchet wrench of FIG. 2, with a socket ejector in the retracted position and with a socket (shown in phantom) in working position on the drive stud.
Figure 4:
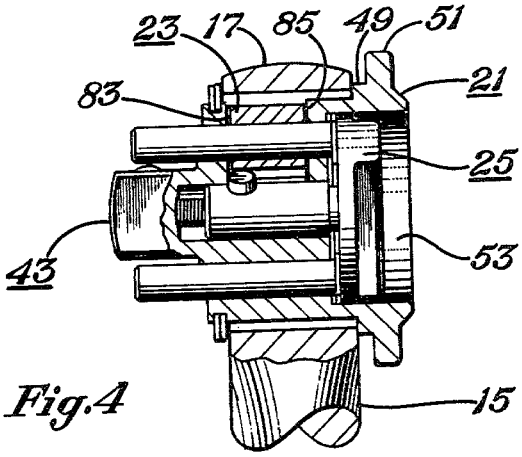
FIG. 4 is like FIG. 3, but with the socket ejector in the extended or ejecting position (the socket has been ejected).
Figure 5:
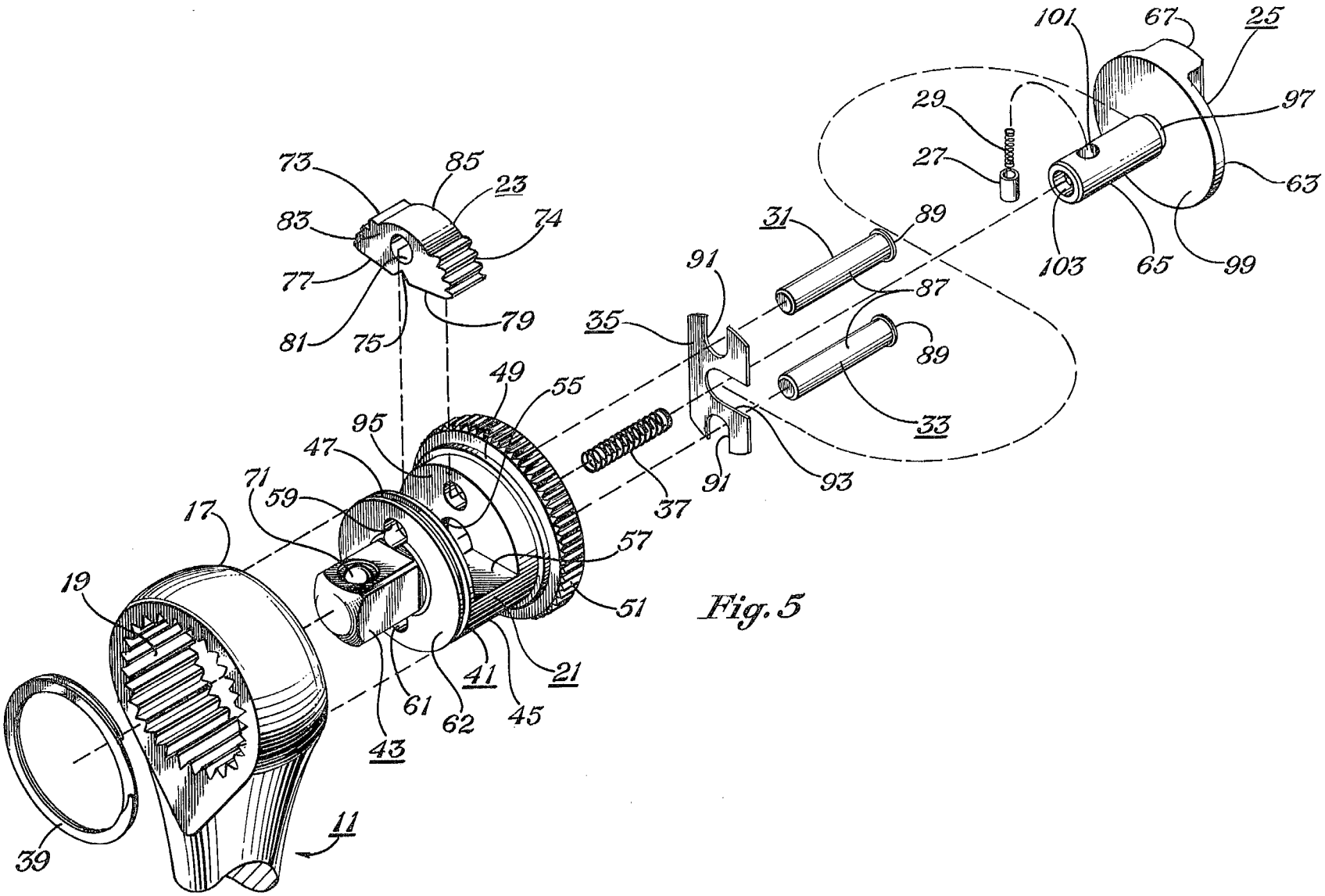
FIG. 5 is an exploded perspective view of the ratchet drive assembly.

In operation, a socket 109 (shown in phantom in FIG. 3) is installed on the drive stud portion 43 and is held in place in a conventional manner by action of the detent ball 71. The control knob 25 is then in the ejector pin retracted position and the ratchet pawl 23 (as shown by FIG. 3) is in the drive clockwise and ratchet counter clockwise position. To drive counter clockwise and ratchet clockwise the control knob 25 is simply rotated to its extreme clockwise position, causing the ratchet reverse pin 27 to shift its position on the inner surface of the ratchet pawl 23 so as to pivot the ratchet pawl on the first ejector pin 31 so as to disengage one set of pawl teeth 74 and engage the other set 73. To eject the socket 109, the control knob 25 is depressed to the ejector pin extended position (see FIG. 4) and the socket 109 is pushed by the ejector pins 31, 33 out of engagement with the detent ball 71 and off the end of the drive stud 43.

The specifications for a satisfactory socket ejector means to be incorporated in a ratchet wrench present a difficult problem of design. Such specifications would ideally require that socket ejector means should be susceptible to easy, convenient and effective operation; and should not adversely affect the ratcheting, reversing or torqueing aspects of the wrench from any of the structural, durability, manufacture or operational standpoints. A ratchet wrench that is constructed in accordance with this present invention, as exemplified by the preferred embodiment herein shown and described, approaches the specifications above mentioned. Some features of ratchet wrenches constructed in accordance with the invention may be noted.

A single control means for independently actuating the reversing means and the ejector means is provided. In the embodiment shown, the single control means is the control knob 25, which is rotated to its extreme clockwise (or counter clockwise) position to effect a ratchet reversing action, and which is depressed to ejector pin extended position to effect socket ejection. The reversing means in the embodiment shown is the spring biased reversing pin 27 coacting with the inner surface 75, 77, 79 of ratchet pawl 23; and the ejector means is the ejector pins 31, 33 and coacting parts.

The ratchet plug body portion 41 contains an axial cylindrical recess 53 opening to the body portion end opposite the socket drive stud 43, and a control knob 25 is disposed substantially within the recess and is rotatable to actuate the reversing means and is reciprocable to actuate the ejector means. Spring bias means 37 is provided for urging the control knob 25 toward the ejector means retracted position. Movement of the control knob 25 in the ejector means extended position is limited by the coaction of the control knob inner face 99 with the recess bottom surface 69 and movement of the control knob 25 in the ejector means retracted position is limited by coaction of the reversing pin 27 and the slot side face 95. One of the ejector pins 31 also serves as the bearing and pivot support for the ratchet pawl 23.

The foregoing disclosure and the showings made in the drawings are merely illustrative of the principles of this invention and are not to be interpreted in a limiting sense.

What is claimed is:

1. A ratchet wrench of the socket drive type with socket ejector comprising:

a. a handle having a lever portion and a head portion, with the head portion having a central bore with internal spline-like teeth formed therein and oppositely disposed side faces;

b. a ratchet plug assembly installed in the head portion of said handle and including:

i. a ratchet plug with a body portion having an integral socket drive stud protruding axially outwards beyond one of said head portion side faces, an axial cylindrical recess opening to the body portion end opposite said socket drive stud, and a pair of spaced parallel ejector pin bores extending through said body portion and adjacent to respective side margins of said socket drive stud and opening to said axial cylindrical recess;

ii. ratchet pawl means for driving or ratcheting on said spline-like teeth and reversing means therefor;

iii. a control knob disposed in said axial cylindrical recess for reciprocable movement therein, with said control knob having a head portion which has an inner face and a stub shaft portion extending axially inward from said inner face;

iv. an ejector pin retainer plate disposed on said stub shaft adjacent said inner face; and, v. a pair of ejector pins carried by said retainer plate and disposed in said ejector pin bores, with said ejector pins bearing at one end on said inner face and restrained by said retainer plate against movement in the direction away from said inner face.

2. A ratchet wrench of the socket drive type with socket ejector comprising:

a. a handle having a lever portion and a head portion, with the head portion having a central bore with internal spline-like teeth formed therein and oppositely disposed side faces;

b. a ratchet plug assembly installed in the head portion of said handle and including:

i. a ratchet plug with a body portion having an integral socket drive stud protruding axially outwards beyond one of said head portion side faces, an axial cylindrical recess opening to the body portion end opposite said socket drive stud, and a pair of spaced parallel ejector pin bores extending through said body portion and adjacent to respective side margins of said socket drive stud and opening to said axial cylindrical recess;

ii. ratchet pawl means for driving or ratcheting on said spline-like teeth and reversing means therefor;

iii. a control knob disposed in said axial cylindrical recess for reciprocable movement therein, with said control knob having a head portion which has an inner face and a stub shaft portion extending axially inward from said inner face;

iv. an ejector pin retainer plate disposed on said stub shaft adjacent said inner face and having oppositely disposed side slots, and, v. a pair of ejector pins disposed within said retainer plate side slots and inserted in said ejector pin bores.

* * * * *